United States Patent [19]

Martin et al.

[11] Patent Number: 4,761,629

[45] Date of Patent: Aug. 2, 1988

[54] INJECTION MOLDABLE CORE INSULATION TUBES

[75] Inventors: Richard W. Martin; Herbert J. Macemon; William R. Fortenberry, all of Versailles, Ky.

[73] Assignee: Kuhlman Corporation, Troy, Mich.

[21] Appl. No.: 908,837

[22] Filed: Sep. 18, 1986

[51] Int. Cl.[4] ..... H01F 27/30

[52] U.S. Cl. ..... 336/208; 174/52 R; 174/138 E; 220/4 E; 336/198; 242/7.13

[58] Field of Search ..... 220/4 B, 4 E, DIG. 25; 242/7.03, 7.13; 174/138 E, 52 R; 336/146, 148, 149, 198, 196, 208, 229

[56] References Cited

U.S. PATENT DOCUMENTS

| | | | |
|---|---|---|---|
| 1,897,604 | 2/1933 | Clemons | 336/229 |
| 2,865,086 | 12/1958 | Whipple | 336/229 |
| 3,122,898 | 12/1963 | Staahl | 336/198 |
| 3,316,517 | 4/1967 | Ellin | 336/146 |
| 3,363,210 | 1/1968 | Hollyday | 336/208 |
| 3,537,051 | 10/1970 | Helberg | 336/148 |
| 3,943,412 | 3/1976 | Wickstrom | 174/52 R |
| 3,946,350 | 3/1976 | Goto | 336/208 |
| 3,989,200 | 11/1976 | Bachi | 242/7.13 |
| 4,602,122 | 7/1986 | Lint | 174/52 R |
| 4,646,803 | 3/1987 | Hanaoka | 336/198 |

FOREIGN PATENT DOCUMENTS

| | | | |
|---|---|---|---|
| 1271637 | 8/1961 | France | 220/4 E |

OTHER PUBLICATIONS

IBM Technical Disclosure Bulletin, vol. 5, No. 1, Jun. 1962, "Container", C. F. Foytlin and D. G. Leck.

*Primary Examiner*—George E. Lowrance
*Attorney, Agent, or Firm*—Townsend and Townsend

[57] ABSTRACT

A toroidal transformer insulation tube includes first and second identical, molded plastic U-channel halves. The halves each have an arcuate bottom and generally semi-cylindrical sides which extend upwardly from the bottom and terminate in inner and outer edges. The edges have symmetrically arranged alternating lapped sections, radially offset from adjacent lapped sections, so that when one U-channel half is mounted to another U-channel half with their edges aligned, the lapped sections overlap to restrict relative radial and rotary motion between the U-channel halves. Thickened flanges are formed at the ends of the halves for strength and for keeping the electrical windings on the insulation tube. The flanges have lead slots, facing in opposite axial directions, formed therein for receipt of transformer leads so that the leads in opposed slots of opposed tubes are spaced apart.

14 Claims, 2 Drawing Sheets

INJECTION MOLDABLE CORE INSULATION TUBES

BACKGROUND OF THE INVENTION

In the prior toroidal transformer, disclosed in application Ser. No. 06/750,045, filed June 27, 1985, entitled "Toroidal Electrical Transformer and Method of Producing Same," this application being a continuation of 06/337,356, filed Jan. 6, 1982, and in a copending application, Ser. No. 06/662,312, filed Oct. 17, 1984, entitled "Apparatus And Method For Fabricating A Low Voltage Winding For A Toroidal Transformer", an insulation structure surrounded the core (and bobbin if used) and served to insulate the low voltage winding from the core. This insulation was in the form of an arcuate (semi-toroidal) tube upon which the low voltage winding was wound. After the low voltage winding was wound, assembled with the high voltage winding, and placed in position with a similar assembly to form approximately 330° of a toroid, a core was wound into the toroidal passage provided by the two insulating tubes.

Each insulating tube was made from electrical kraft insulating paper which was wet molded into the form of the tube. As is well known in the art, electrical kraft paper performs an insulating function by virtue of oil impregnation. Because of the excellent insulation properties of oil-impregnated electrical kraft paper, electrical kraft paper is widely used in transformer construction. To insure proper oil impregnation of the kraft paper, and thereby insure that the insulation will have the appropriate dielectric strength, transformers are typically heated and evacuated after assembly to remove the moisture and air from the kraft paper. While in such an evacuated state, oil is introduced into the transformer which occupies the microscopic spaces within the electrical kraft paper which were occupied by air before the evacuation.

In recent years, the transformer industry has made various efforts to substitute plastic materials for the successful and widely-used oil-impregnated electrical kraft paper, but only with limited success. Oil-impregnated electrical kraft paper continues to be the preferred insulation material in the oil-insulated transformer industry.

In the above-referenced applications, the molded, oil-impregnated, electrical kraft insulation paper functioned well. However, even though kraft electrical paper can be successfully molded by wetting the paper, it was an expensive process. The wet molding process, as is well known, requires a time-consuming drying step before the molded paper insulation can be used. Efforts to speed up the drying process through the application of heat have been only partially successful since very high temperatures, which would cause the water to vaporize into steam, would damage the paper. Accordingly, only relatively low temperatures can be used resulting in long drying times.

In addition to the cost disadvantage of the molded paper insulation, the electrical kraft paper tube had strength limitations relative to the heavy forces imposed upon the tube when heavy gauge conductors were wound upon the tube. This required the use of a relatively close-fitting arbor placed internally of the tube to support the walls of the tube during winding as disclosed in the pending patent application of Randall L. Schlake, et al., Ser. No. O6/698,981,filed Feb. 6, 1985, entitled "Apparatus And Method For Fabricating A Low Voltage Winding For A Toroidal Transformer". To prevent the walls from collapsing during winding of the relatively heavy gauge conductor, it was necessary to have close dimensional correspondence between the electrical kraft paper tube and the internally-positioned arbor. That dimensional requirement complicated the manufacture of the electrical kraft paper tube since it added a manufacturing tolerance which was not easily met in a wet molded paper product.

SUMMARY OF THE INVENTION

This invention provides an improved tube to contain the core (and bobbin, if used) of a toroidal transformer generally of the type disclosed in the aforementioned applications, the disclosures of which are incorporated herein by reference thereto. The insulating tube of the present invention is especially adapted to facilitate either the winding or the mounting of a conductor onto the tube. The winding illustrated in this specification is the low voltage winding. However, the present invention would also apply to a high voltage winding. In its preferred forming, the tube additionally has an integral flange at each end for securing that winding in position on the tube and for securing the leads of the winding.

The present invention advantageously uses an injection molded plastic such as the plastic material available from General Electric and identified by the trade designation "Valox DR 51", a plastic material known to be suitable for use as an insulator in transformers.

The present invention also provides a core insulation tube which is injection-moldable from a plastic material and which is a functional substitute for the prior core insulation tube which was wet molded from electrical kraft insulating paper. The present invention accomplishes that end through a novel application of such plastic material and using a novel configuration of a core insulating tube.

One advantage of the present invention is that a core insulation tube is manufactured from two identical U-channel halves which are opposable and joinable to form an enclosed semi-toroidal passageway. Each U-channel half is provided with a flange at each end which joins with the flange of the mated identical half to form a pair of end flanges on the semi-toroidal core tube. The end flanges are preferably integrally molded with the core tube itself, rather than being separately fabricated and joined to a pre-molded core tube, as disclosed in the aforementioned applications. These flanges serve to retain the winding on the core tube, but additionally serve to conveniently secure the leads of the winding after the winding operation is completed. This latter function is accomplished by providing a slot in the radially-outward portion of the flange which is dimensioned to receive the leads from one end of the winding arranged in a single layer. Preferably, the slot is sufficiently deeper than the accumulative width of the leads of one end of the low voltage winding to permit an excess portion of the overlying flange material to be secured, e.g. by ultrasonic welding, to the core tube itself to close off the end of the slot and thereby retain the leads of each respective end of the winding in place.

The slots in the flange at one end of the tube are axially offset relative to the slots in the flange at the other end of the core tube. Upon assembly of the toroidal transformer, the leads of one low voltage winding assembly, secured within the slot, are axially offset relative to the leads of the opposing low voltage winding assembly which are similarly secured within the slot at the other end of the core tube. The two leads therefore do not overlap along the axial direction and can be bent and extended from the low voltage winding to the exterior of the toroidal transformer with a space requirement of only one wire thickness, thus limiting the size of the required gap between the two respective winding assemblies.

In the preferred embodiment, the edges of both the radially-inside and the radially-outside circumferential walls of the U-shape channel of each half are provided with alternating sections of half thickness. The alternating half thickness sections are arranged symmetrically about a plane of symmetry so that the half thickness sections of one-half will overlap the opposing half thickness sections of the other half upon mating of the two halves. This provides alternating overlaps of the mating inside and outside circumferential walls of the two halves and serves to lock the two halves in a fixed position relative to each other, thereby preventing relative rotation of the two halves about the axis of the semi-toroid, and preventing radially-inward or -outward motion of the two halves. Additionally, the lapped sections provide convenient areas for welding or other joining of the two halves. Other mating features, such as male and female parts which interlock, may be used; and in the preferred embodiment, one such interlock feature is advantageously located in the increased cross-sectional thickness provided by the end flanges. These mating male and female parts can be conveniently sonically welded to increase the strength of the bond between the two mated halves.

The present invention also provides an advantageous feature in that the depth of the U-shape channel can be readily modified through mold inserts which provide a new mold bottom at the desired new depth of the U-shape channel. Conveniently, the bottom portion of the mold is quite simple in form, and therefore, its form can be duplicated conveniently with a mold insert. By this means, the same basic tooling can be used to produce core insulating tubes of various core volumes or sizes to provide different size (power carrying capacity, e.g., KVA) transformers.

Other features and advantages of the invention will appear from the following description in which the preferred embodiment has been set forth in detail in conjunction with the accompanying drawings.

DETAILED DESCRIPTION OF THE PREFERRED EMBODIMENT

Figure 1A:
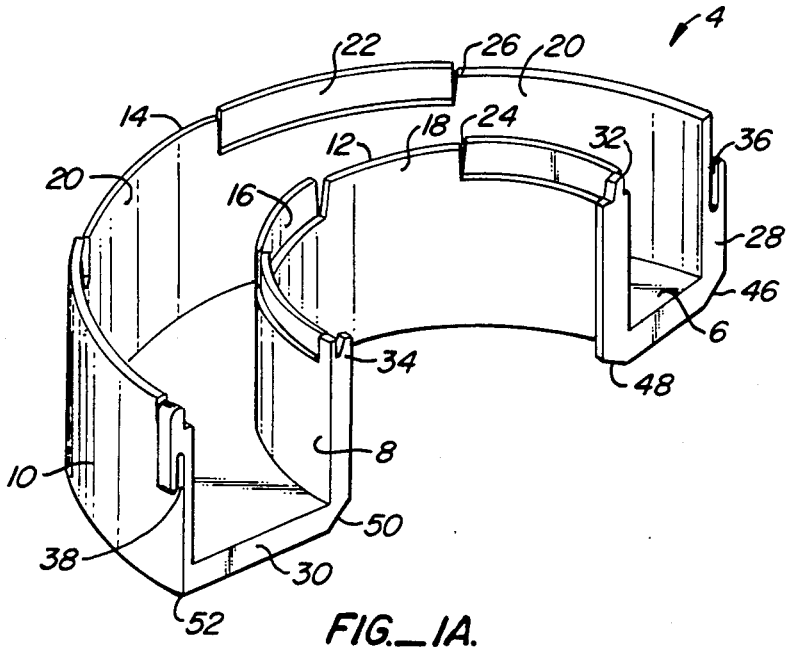
FIG. 1A is a perspective view showing a U-channel half of the insulation tube of the invention.
Figure 1B:
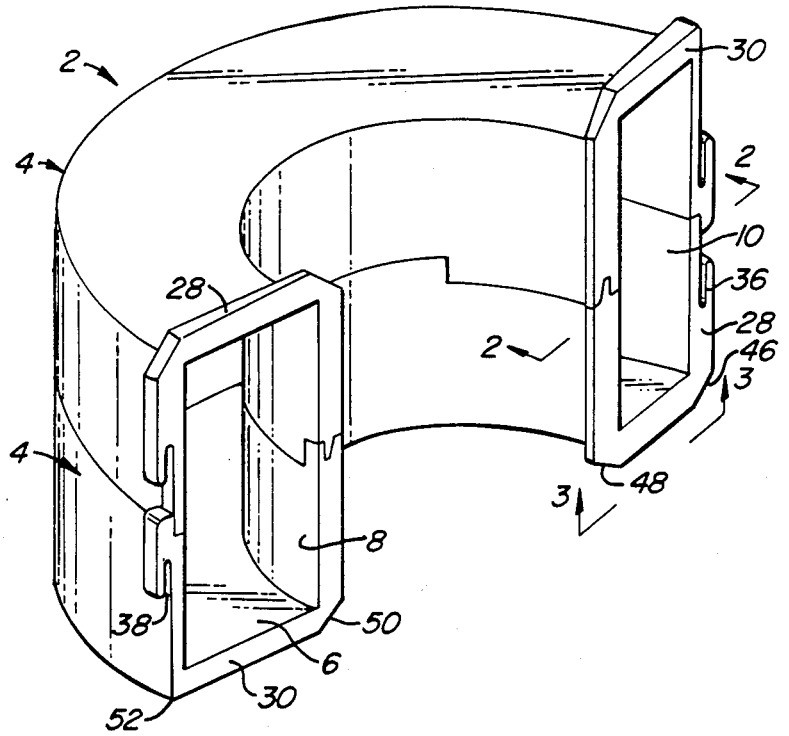
FIG. 1B shows two U-channel halves of FIG. 1A mounted to one another forming an insulation tube according to the invention.

Turning now to FIGS. 1A and 1B, a generally semicircular tube 2 is illustrated which is made from an injection moldable plastic material in two identical parts. The arc of the insulation tube 2 are preferably about 165° (in one preferred embodiment 164°), but can vary over a range of 150° to 175° . Moreover, one or more features of the invention may be used at dimensions outside that range to obtain the corresponding advantages. U-channel half 4 includes a generally semicircular bottom 6, defining an arc of about 165°, and generally semi-cylindrical inner and outer walls 8, 10 extending parallel to one another and generally perpendicular from bottom 6.

Walls 8, 10 terminate at radially-inner and radially-outer edges 12, 14, respectively. Edges 12, 14 have alternating lapped sections 16, 18, 20 and 22 of half thickness. Alternating lapped sections 16–22 are positioned symmetrically about an axially and radially oriented plane passing through the centers of inner and outer walls 8, 10. With this arrangement, identical U-channel halves 4 can be used for both the bottom and top halves of insulation tube 2 with alternating lapped sections 16 and 18 of one U-channel half overlapping corresponding alternating lapped sections 18, 16, respectively, of the other U-channel half 4. Similarly, alternating lapped sections 20, 22 of the bottom U-channel half engage with corresponding alternating lapped sections 22, 20, respectively, of the upper U-channel half. To permit this engagement, narrow gaps 24, 26 are provided between alternating lap sections 16, 18 and between sections 20, 22. This arrangement of alternating lap sections, which can then be secured to one another by ultrasonic welding or other fastening or bonding means, effectively prevents relative rotary and radial motion between the upper and lower U-channel halves 4 of insulation tube 2.

Figure 2:
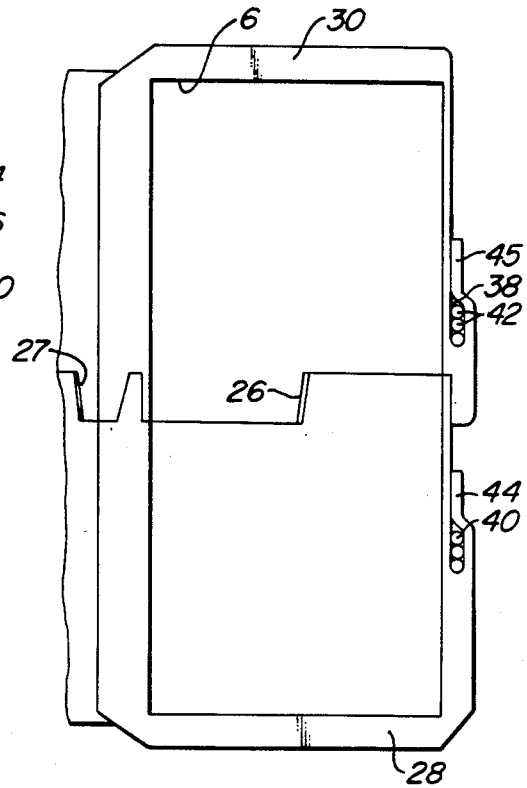
FIG. 2 is an end view taken along line 2—2 of FIG. 1B.
Figure 3:
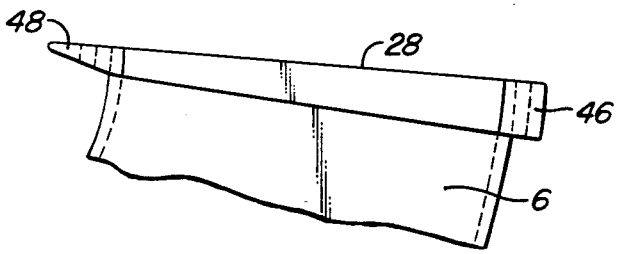
FIG. 3 is a bottom view of one end flange of the insulation tube taken along line 3—3 of FIG. 1B.

As shown in FIGS. 2 and 3, each U-channel half 4 has wedge shaped end flanges 28, 30 at its open ends. Flanges 28, 30 act to maintain windings on the outer surface of tube 2 and help strengthen insulation tube 2 to make tube 2 more rigid. Flanges 28, 30 have male and female mating portions 32, 34 adjacent the inner edge 12 of inner wall 8. This interconnection, when U-channel halves 4 are secured to one another, adds further strength and stability to insulation tube 2.

Figure 4:
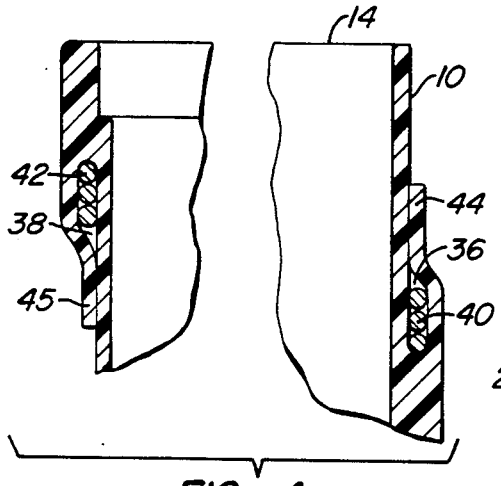
FIG. 4 is an enlarged cross-sectional view of a portion of the U-channel half of FIG. 1A showing the axial offset of the leads in the lead slots at each end of the U-channel half.

Flanges 28, 30 include respective upwardly and downwardly opening electrical lead slots 36, 38. These slots, formed as integral parts of flanges 28, 30, provide a receptacle for securing leads 40, 42, as shown in FIGS. 2 and 4. This is accomplished, in the preferred embodiment by deforming ends 44, 45 inwardly and ultrasonically welding them to the outer wall 10. Other methods for securing leads 40, 42, such as ultrasonically welding blocks of material at the opening of slots 36, 38, can be used as well. As seen in FIG. 4, leads 40 are offset axially from leads 42. This is an important aspect of the invention because it allows leads from the transformer, shown in FIG. 4 at a first insulation tube 2 to be positioned at a different axial position with respect to the leads emanating from the transformer and secured to second insulation tube 2 opposite the first tube. That is, assuming two insulation tubes 2 are used with a transformer, the arc of insulation tubes 2 preferably being about 164°, the flanges 28, 30 at one end of one insulation tube 2 will be opposite flanges 30, 28 of the other insulation tube 2 with the lead slots 36, 38 of the one tube 2 lying opposite the lead slots 38, 36 of the other insulation tube 2.

Corners 46, 48 of flange 28 and corner 50 of flange 30 are chamfered to provide clearance for a winding wheel when winding low voltage windings. Corner 52 of flange 30 is not chamfered or broken since it is already inset relative to the opposite side 50.

In use, suitable primary and secondary windings are mounted or wound onto two toroidally-arranged tubes 2, and thereafter, a core is wound into the tubes 2 as disclosed in the foregoing applications. Preferably, one winding is wound directly upon the tube 2, e.g., as shown by the Schlake application. Each of the tubes 2 and their respective windings are thereafter inserted into respective ones of the other transformer windings. Optionally, the core can be wound into the toroidally-arranged tubes 2 with their windings using a bobbin, also as disclosed in the foregoing applications.

Modification and variation can be made to the disclosed embodiment without departing from the subject of the invention as defined in the following claims. For example, but without limitation although ultrasonic welding of the halves is preferred, other modes of securing the halves together could be used as well.

What is claimed is:

1. An insulation tube for use with a toroidal transformer comprising:

first and second identical U-channel halves defining a common axis, each half made of a plastic electrical insulation material, having an arcuate bottom with first and second edges and having inner and outer walls extending from the first and second edges of the bottom, the inner and outer walls having respective inner and outer edges;

the first and second U-channel halves being secured to one another along the inner and outer edges; and the U-channel halves each having first and second electrical lead slots formed at the first and second ends for receipt of electrical transformer leads, the first and second lead slots being axially oriented and positioned so that electrical leads positioned therein are axially spaced apart and are directed generally normal to and away from the first and second ends and towards respective second and first ends of an opposed insulation tube with opposed transformer leads being axially offset from one another.

2. The insulation tube of claim 1 wherein the inner and outer walls are partially cylindrical in shape and coaxial with the common axis.

3. The insulation tube of claim 1 wherein said first and second U-channel halves are generally semi-circular in shape.

4. The insulation tube of claim 1 wherein at least one of the inner and outer edges have interlocking sections, the interlocking sections being symmetrically arranged on either side of a plane passing through the inner and outer edges and being complementary in configuration.

5. The insulation tube of claim 4 wherein both of said inner and outer sections have alternating interlocking sections.

6. The insulation tube of claim 1 wherein the U-channel halves each have first and second open ends.

7. The insulation tube of claim 6 wherein the U-channel halves have integrally formed, radially outwardly extending flanges at the first and second ends.

8. The insulation tube of claim 7 wherein the flanges have chamfered corners.

9. The insulation tube of claim 7 wherein the flanges are pie-shaped.

10. The insulation tube of claim 1 further comprising means securing the electrical transformer leads in the slots.

11. The insulation tube of claim 4 wherein said interlocking sections comprise lapped portions of said one of said inner and outer edges which are configured to overlap complimentary lapped portions of said second U-channel half.

12. The insulation tube of claim 11 wherein said lapped portions alternate along said one of the inner and outer edges so as to first overlap with said second U-channel half radially outside thereof and next radially inside thereof.

13. The insulation tube of claim 4 wherein said interlocking sections are arranged symetrically on either side of a radially extending plane passing through the center of said inner and outer edges.

14. An insulation tube for use with a toroidal transformer comprising:

first and second identical U-channel halves having first and second open ends, each half made of a plastic insulation material, an arcuate bottom with first and second edges, semi-cylindrical inner and outer walls extending from the first and second edges of the bottom parallel to one another and in an axial direction, the inner and outer walls having respective inner and outer edges;

both of the inner and outer edges having alternating lapped sections, the lapped sections being symmetrically arranged on either side of a radially extending plane passing through the centers of the inner and outer edges, the first and second U-channel halves being secured to one another with said lapped sections of said inner and outer edges of said first U-channel half in overlapping engagement with complementary lapped sections of said second U-channel half; and radially outwardly extending flanges at the first and second edges with first and second electrical lead slots, the lead slots being oriented and having open tops facing in opposite axial directions and bottoms which are axially spaced apart so that electrical leads mounted therein are offset axially from one another and extend generally normally to the first and second ends.

* * * * *